United States Patent [19]

Nagelkerke

[11] 4,393,585

[45] Jul. 19, 1983

[54] DRY-SHAVING APPARATUS WITH HAIR-TRIMMING MEANS

[75] Inventor: Petrus J. J. Nagelkerke, Drachten, Netherlands

[73] Assignee: U.S. Philips Corporation, New York, N.Y.

[21] Appl. No.: 262,235

[22] Filed: May 11, 1981

[30] Foreign Application Priority Data

Jun. 25, 1980 [NL] Netherlands ..... 8003670

[51] Int. Cl.[3] ..... B26B 19/20

[52] U.S. Cl. ..... 30/34.1; 30/201

[58] Field of Search ..... 30/34.1, 201, 200, 90

[56] References Cited

U.S. PATENT DOCUMENTS 3,781,990 1/1974 Loner ..... 30/34.1
3,855,697 12/1974 Meyer ..... 30/34.1
4,262,415 4/1981 Braun ..... 30/34.1

FOREIGN PATENT DOCUMENTS 54-154665 5/1979 Japan ..... 30/201

*Primary Examiner*—Jimmy C. Peters
*Attorney, Agent, or Firm*—Rolf E. Schneider

[57] ABSTRACT

A dry-shaving apparatus is provided with hair-trimming means comprising two pairs of cooperating toothed cutters, each pair of cutters consisting of a reciprocatory cutter and a stationary cutter. One pair of cutters is adjustable between different positions and forms a first hair trimmer of relatively short length for trimming hairs which are not easy to get at with a full-length hair trimmer, for example, hairs in the ears. The other pair of cutters either is arranged for operation in line and in juxtaposition with the first pair of cutters in one of the positions thereof so as to form with the first pair of cutters a second hair trimmer of greater length than the first hair trimmer, or has a greater length than the first pair of cutters and forms a full-length second hair trimmer independently of the first hair trimmer.

5 Claims, 3 Drawing Figures

DRY-SHAVING APPARATUS WITH HAIR-TRIMMING MEANS

Figure 1:
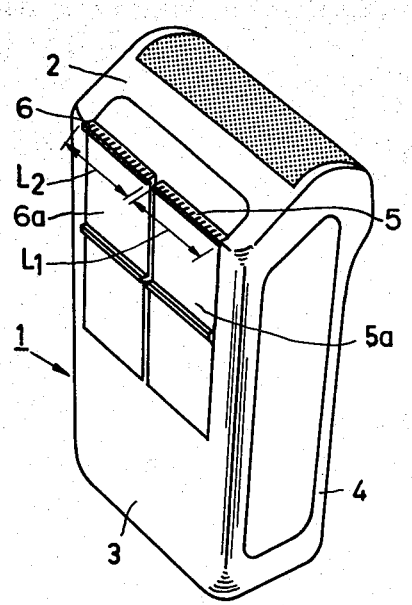

This invention relates to a dry-shaving apparatus having hair-trimming means.

It is well known to provide a dry-shaving apparatus with a hair trimmer in the form of a pair of cooperating toothed cutters of which one reciprocates and the other is stationary in operation. An example of such a hair trimmer is shown in U.S. Pat. No. 3,997,967. This hair trimmer is used for cutting longer hairs. The length of the hair trimmer usually corresponds approximately to the width of the housing of the shaving apparatus. This is convenient for trimming the hair line at the temples or the edge of a beard, for example, but for trimming other facial hairs, for example, the hairs of a moustache or hairs in the ears, a hair trimmer of shorter length would be more convenient.

According to the present invention there is provided a dry-shaving apparatus having hair-trimming means which comprises a first pair of cooperating toothed cutters of which one reciprocates and the other is stationary in operation, which pair of cutters forms a first hair trimmer and is adjustable between different positions, and a second pair of cooperating toothed cutters of which one reciprocates and the other is stationary in operation, which pair of cutters is arranged for operation in line and in juxtaposition with the first pair of cutters in at least one of said positions thereof so as to form with the first pair of cutters a second hair trimmer of greater length than the first hair trimmer measured in the direction of reciprocation of the reciprocatory cutters, or a second pair of cooperating toothed cutters of which one reciprocates and the other is stationary in operation, which pair of cutters has a greater length than the first pair of cutters measured in the direction of reciprocation of the reciprocatory cutter of each pair of cutters and is arranged to form independently of the first pair of cutters a second hair trimmer of greater length than the first hair trimmer.

In one embodiment of the invention the hair-trimming means comprises a first pair of cooperating toothed cutters of which one reciprocates and the other is stationary in operation, which pair of cutters forms a first hair trimmer and is adjustable between different positions, and a second pair of cooperating toothed cutters of which one reciprocates and the other is stationary in operation, which pair of cutters is arranged for operation in line and in juxtaposition with the first pair of cutters in at least one of said positions thereof so as to form with the first pair of cutters a second hair trimmer of greater length than the first hair trimmer measured in the direction of reciprocation of the reciprocatory cutters, the two pairs of cutters being mounted on one wall of the housing of the apparatus.

In this embodiment the two pairs of cutters may have equal lengths measured in the direction of reciprocation of the reciprocatory cutters, and the second pair of cutters also may be adjustable between different positions which correspond to said positions of the first pair of cutters.

In another embodiment of the invention the hair-trimming means comprises a first pair of cooperating toothed cutters of which one reciprocates and the other is stationary in operation, which pair of cutters forms a first hair trimmer and is adjustable between different positions, and a second pair of cooperating toothed cutters of which one reciprocates and the other is stationary in operation, which pair of cutters has a greater length than the first pair of cutters measured in the direction of reciprocation of the reciprocatory cutter of each pair of cutters and is arranged to form independently of the first pair of cutters a second hair trimmer of greater length than the first hair trimmer, the two pairs of cutters being mounted on different walls of the housing of the apparatus.

In this embodiment the dry-shaving apparatus may have a housing of substantially rectangular cross-section with two oppositely disposed wide side walls and two oppositely disposed narrow side walls, and the first pair of cutters may be mounted on one of the narrow side walls and the second pair of cutters on one of the wide side walls.

Figure 2:
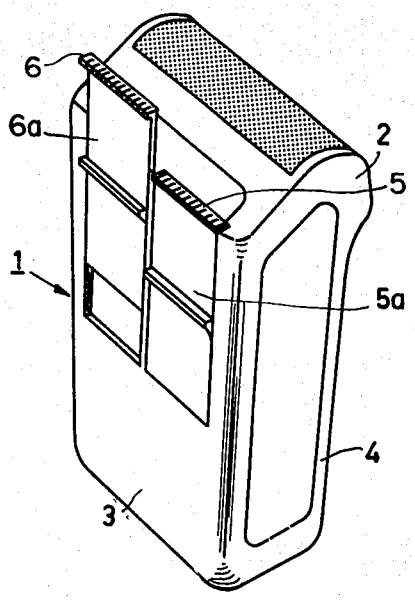
Figure 3:
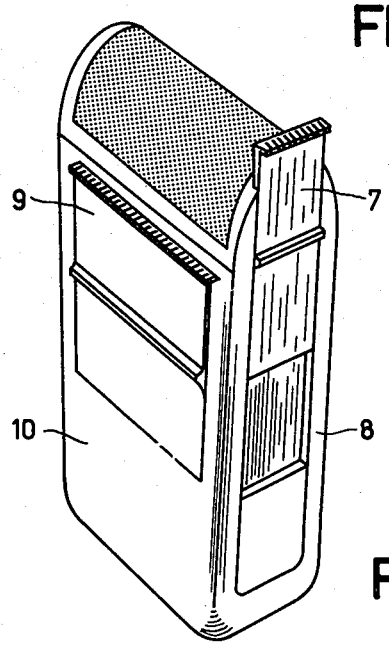

The invention will now be described in more detail with reference to the accompanying drawings, in which FIG. 1 is a perspective view of a reciprocatory dry-shaving apparatus according to a first embodiment of the invention, FIG. 2 is a perspective view of the shaving apparatus of FIG. 1 showing one of the two pairs of cooperating cutters of the hair-trimming means in an extended position, and FIG. 3 is a perspective view of a reciprocatory dry-shaving apparatus according to a second embodiment of the invention.

The shaving apparatus shown in FIGS. 1 and 2 has a housing 1 with a shaving head 2. The housing 1 is of substantially rectangular cross-section with two oppositely disposed wide side walls 3 and two oppositely disposed narrow side walls 4. On one of the wide side walls is mounted hair-trimming means comprising a pair of cooperating toothed cutters 5 and a pair of cooperating toothed cutters 6. Only one cutter of each pair is shown in the drawings. Of the two cutters of each pair, one reciprocates and the other is stationary in operation, the two cutters of each pair cooperating with one another in conventional manner. The two pairs of cutters are identical, their lengths $L_1$ and $L_2$ respectively, measured in the direction of reciprocation of the reciprocatory cutters, being equal. Each pair of cutters is carried independently by a plate-shaped support 5*a* and 6*a* respectively, which is slidable on the wall of the housing 1 to adjust the respective pair of cutters between a retracted position, which is the position occupied by both pairs of cutters in FIG. 1, and an extended position, which is the position occupied by the pair of cutters 6 in FIG. 2. The reciprocatory cutter of each pair is arranged to be driven in both positions by conventional driving means (not shown). When one of the two pairs of cutters is in the extended position and the other is in the retracted position, as shown in FIG. 2 for example, the extended pair forms a hair trimmer of short length which can be used for trimming facial hairs which are located in constricted areas or in places which are not readily accessible to a full-length hair trimmer, for example, the moustache, nose, ears and eyebrows. When both pairs of cutters occupy the same position, i.e. the retracted position, as shown in FIG. 1, or the extended position, they are juxtaposed in line with one another and together form a full-length hair trimmer for trimming the hair line at the temples and at the edges of a beard, for example. It is not essential for both pairs of cutters to be adjustable between retracted and extended positions; it is sufficient to have only one pair supported for such adjustment to serve as the short-length hair trimmer. Also, the two pairs of cutters may have different lengths.

In the embodiment shown in FIG. 3, a short-length hair trimmer 7 comprising a pair of cooperating cutters is mounted on a narrow side wall 8 of the housing of the shaving apparatus, and a separate full-length hair trimmer 9 comprising one pair of cooperating cutters is mounted on a wide side wall 10 of the housing. The short-length hair trimmer is slidable on the housing between a retracted position and an extended position, as shown in FIG. 3.

The pair of cutters forming the short-length hair trimmer in FIG. 3, and either or both pairs of cutters in FIGS. 1 and 2, may be supported for pivotal instead of sliding movement between the retracted and extended positions.

The invention may obviously be used in a shaving apparatus having a vibratory driving motor; it may also be used in a shaving apparatus having a rotary driving motor. In the latter case the reciprocatory cutters could be arranged to be driven by the rotary motor through an eccentric and separate driving levers.

What is claimed is:

1. A dry-shaving apparatus provided with hair-trimming means comprising a first pair of cooperating toothed cutters, one being reciprocatory and the other being stationary in operation, said first pair of cutters forming a first hair trimmer and being adjustable between different positions; and a second pair of cooperating toothed cutters, one being reciprocatory and the other being stationary in operation, said second pair of cutters being arranged for operation in line and in juxtaposition with the first pair of cutters in at least one of said positions thereof so as to form with the first pair of cutters a second hair trimmer of greater length than the first hair trimmer measured in the direction of reciprocation of the reciprocatory cutters, or said second pair of cutters having a greater length than the first pair of cutters measured in the direction of reciprocation of the reciprocatory cutter of each pair of cutters and being arranged to form independently of the first pair of cutters a second hair trimmer of greater length than the first hair trimmer.

2. A dry-shaving apparatus including a housing and provided with hair-trimming means comprising a first pair of cooperating toothed cutters, one being reciprocatory and the other being stationary in operation, said first pair of cutters forming a first hair trimmer and being adjustable between different positions; and a second pair of cooperating toothed cutters, one being reciprocatory and the other being stationary in operation, said second pair of cutters being arranged for operation in line and in juxtaposition with the first pair of cutters in at least one of said positions thereof so as to form with the first pair of cutters a second hair trimmer of greater length than the first hair trimmer measured in the direction of reciprocation of the reciprocatory cutters; the two pairs of cutters being mounted on one wall of said housing.

3. A dry-shaving apparatus according to claim 2, in which the two pairs of cutters having equal lengths measured in the direction of reciprocation of the reciprocatory cutters.

4. A dry-shaving apparatus according to claim 2, in which the second pair of cutters also is adjustable between different positions corresponding to said positions of the first pair of cutters.

5. A dry-shaving apparatus including a housing of substantially rectangular cross-section with two oppositely disposed wide side walls and two oppositely disposed narrow side walls and provided with hair-trimming means comprising a first pair of cooperating toothed cutters, one being reciprocatory and the other being stationary in operation, said first pair of cutters forming a first hair trimmer and being adjustable between different positions; and a second pair of cooperating toothed cutters, one being reciprocatory and the other being stationary in operation, said second pair of cutters having a greater length than the first pair of cutters measured in the direction of reciprocation of the reciprocatory cutter of each pair of cutters and being arranged to form independently of the first pair of cutters a second hair trimmer of greater length than the first hair trimmer; the first pair of cutters being mounted on one of the narrow side walls and the second pair of cutters being mounted on one of the wide side walls.

* * * * *